US010625502B2

(12) United States Patent
Chikamoto

(10) Patent No.: US 10,625,502 B2
(45) Date of Patent: Apr. 21, 2020

(54) PIEZOELECTRIC PRINT HEAD AND PIEZOELECTRIC INK JET PRINTER

(71) Applicant: SEIKO EPSON CORPORATION, Tokyo (JP)

(72) Inventor: Motonori Chikamoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/141,046

(22) Filed: Sep. 25, 2018

(65) Prior Publication Data

US 2019/0092004 A1 Mar. 28, 2019

(30) Foreign Application Priority Data

Sep. 27, 2017 (JP) ..... 2017-186449

(51) Int. Cl.
*B41J 2/045* (2006.01)
*B41J 2/14* (2006.01)

(52) U.S. Cl.
CPC ..... *B41J 2/04581* (2013.01); *B41J 2/04515* (2013.01); *B41J 2/04541* (2013.01); *B41J 2/04573* (2013.01); *B41J 2/04588* (2013.01); *B41J 2/04593* (2013.01); *B41J 2/04596* (2013.01); *B41J 2/14233* (2013.01); *B41J 2002/14241* (2013.01); *B41J 2002/14362* (2013.01); *B41J 2002/14491* (2013.01)

(58) Field of Classification Search
CPC ..... B41J 2/04581; B41J 2/04515; B41J 2/04596; B41J 2/04593; B41J 2/04591; B41J 2/04541; B41J 2/04588; B41J 2/14233; B41J 2002/14491; B41J 2002/14419; B41J 2002/14362; B41J 2002/14241
See application file for complete search history.

(56) References Cited

U.S. PATENT DOCUMENTS 8,926,041 B2 1/2015 Rosario et al.
2014/0210884 A1 7/2014 Rosario et al.
2017/0253030 A1* 9/2017 Kumagai ..... B41J 2/04551

FOREIGN PATENT DOCUMENTS

CN 105050813 A 11/2015
JP 4078629 B2 4/2008

* cited by examiner

*Primary Examiner* — Geoffrey S Mruk
(74) *Attorney, Agent, or Firm* — Global IP Counselors, LLP

(57) ABSTRACT

A piezoelectric print head includes a piezoelectric element, a nozzle that ejects liquid when a piezoelectric element is driven, a transmission gate that switches between supply and non-supply of a driving signal for driving the piezoelectric element to the piezoelectric element, a micro-vibration controller that changes a waveform select signal supplied from outside and outputs the waveform select signal if a predetermined condition is satisfied, and a decoder circuit that controls ON/OFF of the transmission gate based on the waveform select signal output from the micro-vibration controller.

15 Claims, 10 Drawing Sheets

FIG. 7

| | S[m] | SP | Ts1 | | Ts2 | |
|---|---|---|---|---|---|---|
| | | | SLa[m] | SLb[m] | SLa[m] | SLb[m] |
| LARGE DOT | (1, 1) | (b1,b2,b3,b4) = (1,0,1,0) | H | L | H | L |
| MEDIUM DOT | (1, 0) | (b5,b6,b7,b8) = (1,0,0,1) | H | L | L | H |
| SMALL DOT | (0, 1) | (b9,b10,b11,b12) = (0,0,1,0) | L | L | H | L |
| MICRO VIBRATION | (0, 0) | (b13,b14,b15,b16) = (0,1,0,0) | L | H | L | L |

PIEZOELECTRIC PRINT HEAD AND PIEZOELECTRIC INK JET PRINTER

This application claims priority to Japanese Patent Application No. 2017-186449 filed on Sep. 27, 2017. The entire disclosure of Japanese Patent Application No. 2017-186449 is hereby incorporated herein by reference.

BACKGROUND

1. Technical Field

The present invention relates to a technology that uses a piezoelectric element for ejecting liquid such as ink.

2. Related Art

On-demand ink jet printers are roughly divided into thermal type that uses a heat generating element, and piezoelectric type that uses a piezoelectric element, as a driving element for ejecting liquid.

The piezoelectric type is more advantageous than the thermal type because the piezoelectric type does not heat ink and hence can handle various kinds of ink, and can precisely control the ejection amount of ink. In the technical field of such a piezoelectric ink jet printer, there is known a print head having a thin-film piezoelectric developed through application of micro electro mechanical systems (MEMS) technology (see Japanese Patent No. 4,078,629). The MEMS technology enables micromachining, and hence nozzles that eject ink can be highly densely arranged in the piezoelectric print head.

However, as the density of arrangement of the piezoelectric print head increases, the heat amount per unit volume increases. The increase in heat amount changes the composition of ink and the properties of ink such as viscosity, thereby increasing the risk of deterioration of ink. The increase in the risk of deterioration represents an increase in possibility that an intended product cannot be obtained due to ejection failure or deterioration of ink. This may impair the advantage of the piezoelectric print head of ejecting various kinds of liquid such as ink without applying heat to the liquid.

SUMMARY

An advantage of some aspects of the invention is reducing the risk of deterioration of liquid to be ejected from a piezoelectric print head.

According to a first aspect of the invention, there is provided a piezoelectric print head including a piezoelectric element, a nozzle that ejects liquid when the piezoelectric element is driven, a switch that switches between supply and non-supply of a driving signal for driving the piezoelectric element to the piezoelectric element, a change unit that changes a control signal supplied from outside and outputs the control signal if a predetermined condition is satisfied, and a switch controller that controls ON/OFF of the switch based on the control signal output from the change unit.

With the aspect, the driving signal is supplied to the piezoelectric element via the switch. Electric power is consumed and heat is generated with the switch operation. Since the change unit changes the control signal supplied from the outside and outputs the control signal to the switch controller if the predetermined condition is satisfied, the switch can be turned OFF based on the predetermined condition. When the switch is turned OFF, the switch operation is stopped. Thus, a temperature rise of the piezoelectric print head is suppressed and hence the risk of deterioration of liquid can be decreased, and further current consumption can be decreased.

In this case, the driving signal may include a micro-vibration waveform that causes the liquid not to be ejected when the micro-vibration waveform is supplied to the piezoelectric element; the control signal may include micro-vibration information for supplying the micro-vibration waveform to the piezoelectric element; the change unit may change a content of the micro-vibration information if the predetermined condition is satisfied; and when the switch is controlled based on the control signal having the changed micro-vibration information, the micro-vibration waveform of the driving signal may not be supplied to the piezoelectric element.

With the aspect, if the predetermined condition is satisfied, the control signal is changed, and the micro-vibration waveform of the driving signal is not supplied to the piezoelectric element. In contrast, if the predetermined condition is not satisfied, when micro-vibration is designated with the control signal, the micro-vibration waveform is supplied to the piezoelectric element. When liquid is ejected from a nozzle, liquid in the nozzle is influenced by heat generated by the piezoelectric print head and the liquid at an increased temperature is ejected. Instead of the liquid at the increased temperature, the nozzle is filled with liquid that is not influenced by the heat generated by the piezoelectric print head and hence that is at a relatively low temperature. Since the nozzle is filled with the liquid at a temperature lower than the temperature of the liquid with which the nozzle was filled until then, the inside of the piezoelectric print head is cooled. In contrast, with micro-vibration, liquid is not ejected. Hence, the cooling effect due to ejection of liquid and filling with new liquid is not obtained, and consequently the temperature rises. With the aspect, the switch can be turned OFF when micro-vibration is designated and the predetermined condition is satisfied. Thus, the influence of heat received by liquid is suppressed and hence the risk of deterioration of liquid can be decreased, and further ejection stability can be increased.

Moreover, with the aspect, the control signal supplied from the outside can be used without being changed. Only by adding a simple configuration to the existing system, micro-vibration can be skipped.

Also, since micro-vibration is skipped if the predetermined condition is satisfied, the effect of decreasing the viscosity of liquid by micro-vibration and the effect of decreasing the temperature rise of the liquid can be well-balanced based on the predetermined condition.

In this case, the liquid may have properties that are deteriorated at a temperature lower than 100° C.

When liquid to be ejected from a nozzle has properties that are deteriorated at a temperature lower than 100° C., the generation of heat with the switch operation is a serious problem. With the aspect, for liquid using alcohol-based liquid as a solvent whose boiling point is at a temperature from 70° C. to 90° C., liquid using water as a solvent whose boiling point is at a temperature from 90° C. to 100° C., and liquid whose boiling point is at a temperature lower than the above, supply of the driving signal to the piezoelectric element is stopped via the switch. Thus, by suppressing generation of heat, the risk of deterioration of liquid can be decreased, and the properties of liquid to be ejected can be stable.

In this case, 400 or more nozzles including the nozzle may be arranged in a row with a density of 300 or more nozzles per inch, and the piezoelectric element, the switch, and the switch controller may be provided for each of the 400 or more nozzles.

When the 400 or more nozzles are arranged in a row with the density of 300 nozzles or more per inch, the temperature per unit volume largely rises due to the generation of heat with the switch operation corresponding to the individual nozzle. With the aspect, the generation of heat with the switch operation can be decreased. Thus, a temperature rise of the piezoelectric print head is suppressed and hence the risk of deterioration of liquid can be decreased, and further current consumption can be decreased.

In this case, a processing period including as one cycle a first period in which the micro-vibration waveform is allowed to be supplied to the piezoelectric element and a second period in which the micro-vibration waveform is not allowed to be supplied to the piezoelectric element may be repeated and hence the nozzle ejects the liquid; and the predetermined condition may be the second period.

With the aspect, the temperature rise of the piezoelectric print head can be suppressed by adjusting the length of the first period and the length of the second period, and the viscosity of the liquid and the temperature rise of the liquid can be well balanced.

In this case, the piezoelectric print head may include a plurality of nozzles including the nozzle; the piezoelectric element, the switch, and the switch controller provided for each of the plurality of nozzles; and the change unit commonly provided for the plurality of nozzles.

With the aspect, since the change unit is commonly provided for the plurality of nozzles, the configuration can be simplified as compared with a case where the change unit is provided for each of the nozzles.

In this case, the piezoelectric print head may further include a circuit board provided with the switch, the change unit, and the switch controller; and a pressure chamber filled with liquid and having an internal pressure that increases and decreases in accordance with driving of the piezoelectric element. The piezoelectric element may be provided in a sealed space that is defined by a plurality of members including the circuit board.

With the aspect, since the sealed space is defined by the plurality of members including the circuit board, the distance between the circuit board and the pressure chamber filled with the liquid is a small distance. Thus, the heat generated by the switch and the switch controller is likely transferred to the liquid in the pressure chamber via the plurality of members. If the predetermined condition is satisfied, the switch controller changes the control signal. The switch can be turned OFF, the temperature rise of the piezoelectric print head can be decreased, and consequently the risk of deterioration of liquid can be decreased.

According to a second aspect of the invention, there is provided a piezoelectric ink jet printer including any one of the above-described piezoelectric print heads, and the liquid is ink. With the aspect, since the temperature rise of the piezoelectric print head can be decreased, the risk of deterioration of ink is suppressed, and printing with high quality can be provided.

BRIEF DESCRIPTION OF THE DRAWINGS

The invention will be described with reference to the accompanying drawings, wherein like numbers reference like elements.

FIG. 7 is an explanatory view showing decoding contents of a decoder circuit.

DESCRIPTION OF EXEMPLARY EMBODIMENTS

Figure 1:
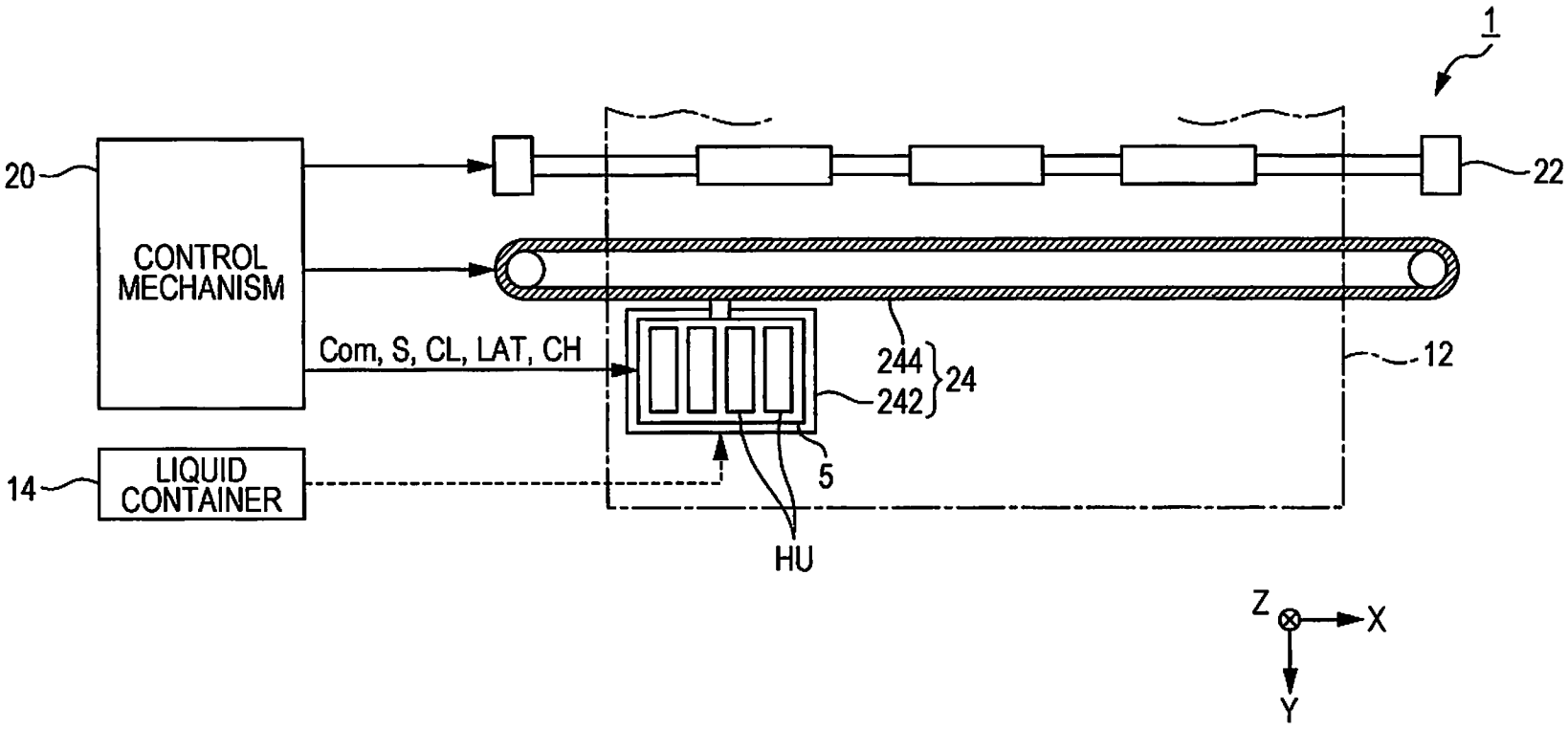
FIG. 1 is a configuration diagram of a piezoelectric ink jet printer according to an embodiment of the invention.

An embodiment for implementing the invention is described below with reference to the drawings. The dimensions and scales of portions in the drawings are properly differentiated from the dimensions and scales of actual portions. Also, an embodiment to be described below is a desirable specific example of the invention, and hence has various technically desirable limitations; however, the scope of the invention is not limited to the embodiment unless otherwise noted to limit the invention in the following description.

1. Embodiment

A piezoelectric ink jet printer 1 according to an embodiment is described below with reference to the drawings.

1-1. Overview of Piezoelectric Ink Jet Printer

FIG. 1 is a configuration diagram showing the piezoelectric ink jet printer 1 according to the embodiment. The piezoelectric ink jet printer 1 according to the embodiment ejects ink, which is an example of liquid, to a medium 12 by driving a piezoelectric element. The medium 12 is typically printing paper; however, any printing object, such as a resin film, a fabric, or a color filter of an organic electroluminescence (EL) display may be used as the medium 12.

As shown in FIG. 1, the piezoelectric ink jet printer 1 includes a liquid container 14 that stores ink. The liquid container 14 may employ, for example, a cartridge attachable to and detachable from the piezoelectric ink jet printer 1, a bag-shaped ink pack formed of a flexible film, or an ink tank that can be replenished with ink. The liquid container 14 stores a plurality of kinds of ink having different colors.

As shown in FIG. 1, the piezoelectric ink jet printer 1 includes a control mechanism 20, a transport mechanism 22, a movement mechanism 24, and a plurality of piezoelectric print heads HU.

The control mechanism 20 includes, for example, a processing circuit, such as a central processing unit (CPU) or a field programmable gate array (FPGA), and a memory circuit such as a semiconductor memory. The control mechanism 20 controls respective elements of the piezoelectric ink jet printer 1. In this embodiment, the transport mechanism 22 transports the medium 12 to the +Y side under the control of the control mechanism 20. In the following description, the +Y side, and the −Y side which is a side opposite to the +Y side may be collectively referred to as the Y-axis direction.

The movement mechanism 24 reciprocates the plurality of piezoelectric print heads HU to the +X side, and the −X side opposite to the +X side under the control of the control mechanism 20. In this case, the +X side is in a direction intersecting with (typically, orthogonal to) the +Y side to which the medium 12 is transported. Hereinafter, the +X side and the −X side may be collectively referred to as the X-axis direction. The movement mechanism 24 has a carriage body (carriage) 242 that houses a head section 5, and an endless belt 244 to which the carriage body 242 is fixed. Alternatively, the liquid container 14 may be mounted on the carriage body 242 together with the piezoelectric print heads HU.

The head section 5 includes the plurality of piezoelectric print heads HU. Each of the plurality of piezoelectric print heads HU is supplied with ink from the liquid container 14. Moreover, each of the plurality of piezoelectric print heads HU receives, supplied from the control mechanism 20, a driving signal Com for driving each piezoelectric print head HU, a latch signal LAT for controlling an ejection timing, a change signal CH for selecting a waveform to be supplied from the driving signal Com, and a control signal S for controlling the piezoelectric print head HU.

The control signal S includes a print signal SI and a waveform select signal SP. The driving signal Com includes a plurality of waveforms. The waveform select signal SP designates which waveform is selected from the plurality of waveforms included in the driving signal Com, for each of a plurality of operation states that can be designated by the print signal SI. Each of the plurality of piezoelectric print heads HU is driven based on the driving signal Com under the control based on the control signal S, the latch signal LAT, and the change signal CH, and causes a portion or the entirety of a number 2M of nozzles (ejection holes) to eject ink to the +Z side (M is a natural number equal to or more than 1).

In this case, the +Z side is in a direction intersecting with (typically, orthogonal to) the +X side and the +Y side. In the following description, the +Z side, and the −Z side which is a side opposite to the +Z side may be collectively referred to as the Z-axis direction. Each piezoelectric print head HU forms a desirable image on a surface of the medium 12, by causing a portion or the entirety of the number 2M of nozzles to eject ink and allowing the ejected ink to be landed on the surface of the medium 12, in association with the transport of the medium 12 by the transport mechanism 22 and the reciprocation of the carriage body 242.

Although the details will be described later, in this embodiment, a high-density piezoelectric print head HU is employed. In this case, high density represents arrangement of nozzles that eject ink with a density of 300 or more nozzles per inch.

With the piezoelectric type, a driving signal Com is selectively supplied to a piezoelectric element via a switch such as a transmission gate. To reduce erroneous ejection due to a malfunction of the switch, the switch is designed to have a sufficiently high on-resistance. Thus, large electric power is consumed with the switch operation, and the switch is one of heat generating factors in the piezoelectric print head. Moreover, with the switch operation of turning the switch OFF from ON or ON from OFF, an output circuit that supplies a select signal to the switch is also one of the heat generating factors in the piezoelectric print head.

When the temperature rises because the switch and the output circuit generate heat, the temperature of ink also rises due to thermal conduction. The change in temperature of ink changes the composition of ink and the properties of ink such as viscosity, thereby increasing the risk of deterioration of ink. Since the piezoelectric print head HU is more advantageous than the thermal print head because the piezoelectric print head HU can eject ink without applying heat to the ink unlike the thermal print head, the ink to be used involves many types of ink sensitive to heat. The temperature rise markedly degrades the advantage of the piezoelectric print head HU.

Particularly with a high-density piezoelectric print head HU in which nozzles are highly densely arranged, due to an increase in density, the heat amount and thermal conduction efficiency to ink increase, and heat release efficiency to the outside decreases.

If a non-ejection state of ink continues, the viscosity of ink may increase and the ink may clog a nozzle. Owing to this, a piezoelectric element may be driven to stir ink and suppress settlement of the ink while the ink is not ejected. This operation is referred to as micro-vibration. When the print signal SI designates micro-vibration, the ink is not ejected but the heat generated by the switch and the output circuit is transferred to the ink.

When ink is ejected, ink at an increased temperature is output to the outside with the ejection, and instead of the ink at the increased temperature, ink at a relatively low temperature flows into the nozzle. The temperature in the nozzle decreases. However, in the case of micro-vibration, the temperature is not decreased with the ejection of ink. In this embodiment, the above-described print signal SI designates an operation state, such as ejection of large-dot ink, ejection of medium-dot ink, ejection of small-dot ink, or micro-vibration causing non-ejection of ink. The waveform select signal SP designates which waveform of the driving signal Com is selected in each operation state.

In this embodiment, if a predetermined condition is satisfied, micro-vibration information for selecting a micro-vibration waveform in the waveform select signal SP is changed so as not to select any waveform. Thus, if the predetermined condition is satisfied, the micro-vibration waveform is not supplied to the piezoelectric element. Consequently, ink is not ejected, and the piezoelectric element is not displaced.

When the waveform select signal SP is changed so as not to supply the micro-vibration waveform to the piezoelectric element, the switch is turned OFF. Thus, the generation of heat of the piezoelectric print head HU is suppressed. Since the generation of heat of the piezoelectric print head HU can be suppressed as described above, the piezoelectric ink jet printer 1 according to this embodiment has a great degree of freedom in ink selection. For example, liquid such as ink whose properties are deteriorated at a temperature lower than 100° C. may be used. Examples of liquid may be liquid using alcohol-based liquid as a solvent whose boiling point is at a temperature from 70° C. to 90° C., liquid using water as a solvent whose boiling point is at a temperature from 90° C. to 100° C., and liquid whose boiling point is at a temperature lower than the above.

1-2. Electric Configuration of Piezoelectric Print Head HU

Figure 2:
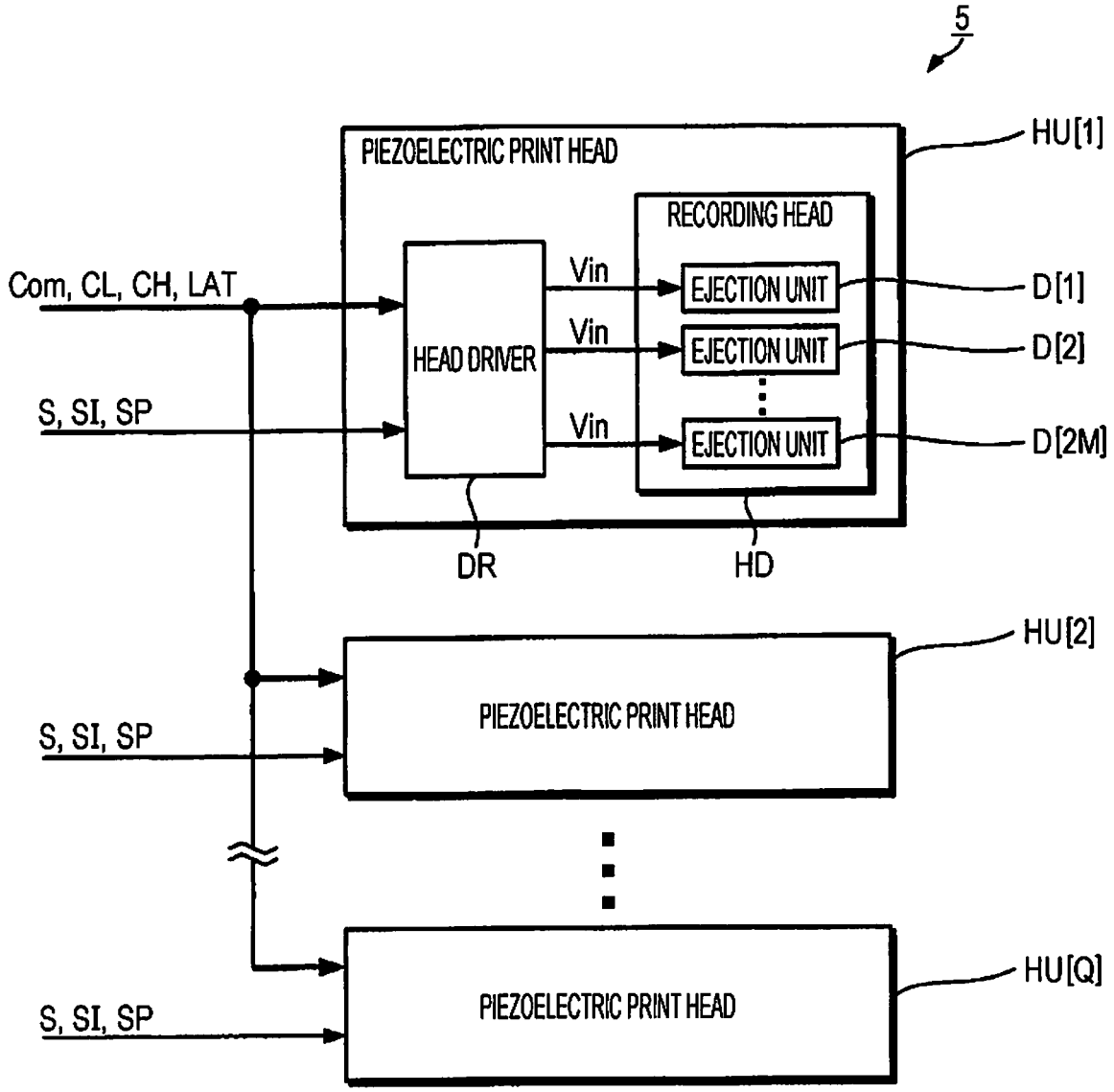
FIG. 2 is a block diagram showing an electric configuration of a head section.

As shown in FIG. 2, the head section 5 includes a number Q of piezoelectric print heads HU (HU[1] to HU[Q]) (Q is a natural number of 2 or larger). A q-th piezoelectric print head HU[q] includes a head driver DR and a recording head HD like a first piezoelectric print head HU[1] (q is a natural number satisfying $1 \leq q \leq Q$). The recording head HD includes a number 2M of ejection units D.

In the following description, the number 2M of ejection units D are occasionally sequentially referred to as 1st stage, 2nd stage, . . . , and 2M-th stage, in order to distinguish the number 2M of ejection units D from one another. In the following description, an m-th-stage ejection unit D among the ejection units D provided on the recording head HD is occasionally expressed as ejection unit D[m] (a variable m is a natural number satisfying 1≤m≤2M).

The driving signal Com, the clock signal CL, the change signal CH, and the latch signal LAT are supplied from the control mechanism 20 commonly to the number Q of piezoelectric print heads HU[1] to HU[Q]. Also, the control signals S including the print signals SI and the waveform select signals SP are supplied individually to the respective number Q of piezoelectric print heads HU[1] to HU[Q]. The print signals SI in this example are provided to correspond to the ejection units D[1] to D[2M] in a one-to-one correspondence, and designate the operation states. The operation states include ejection of large-dot ink, ejection of medium-dot ink, ejection of small-dot ink, and micro-vibration causing non-ejection of ink and supplying the driving signal Com to the piezoelectric element 37.

The driving signal Com is an analog signal having a plurality of waveforms for driving the ejection unit D. The driving signal Com includes a driving signal Com-A and a driving signal Com-B (see FIG. 8). For example, the control mechanism 20 includes a digital-to-analog (DA) converter circuit (not shown), converts a digital driving waveform signal that is generated by the CPU or the like included in the control mechanism 20 into an analog driving signal Com, and outputs the driving signal Com.

As described above, the piezoelectric print head HU[q] includes the head driver DR and the recording head HD. The head driver DR generates individual driving signals Vin for driving the ejection units D[1] to D[2M] included in the recording head HD, based on various signals, such as the driving signal Com, the control signals S, and the change signal CH supplied from the control mechanism 20.

1-3. Structure of Recording Head

Figure 3:
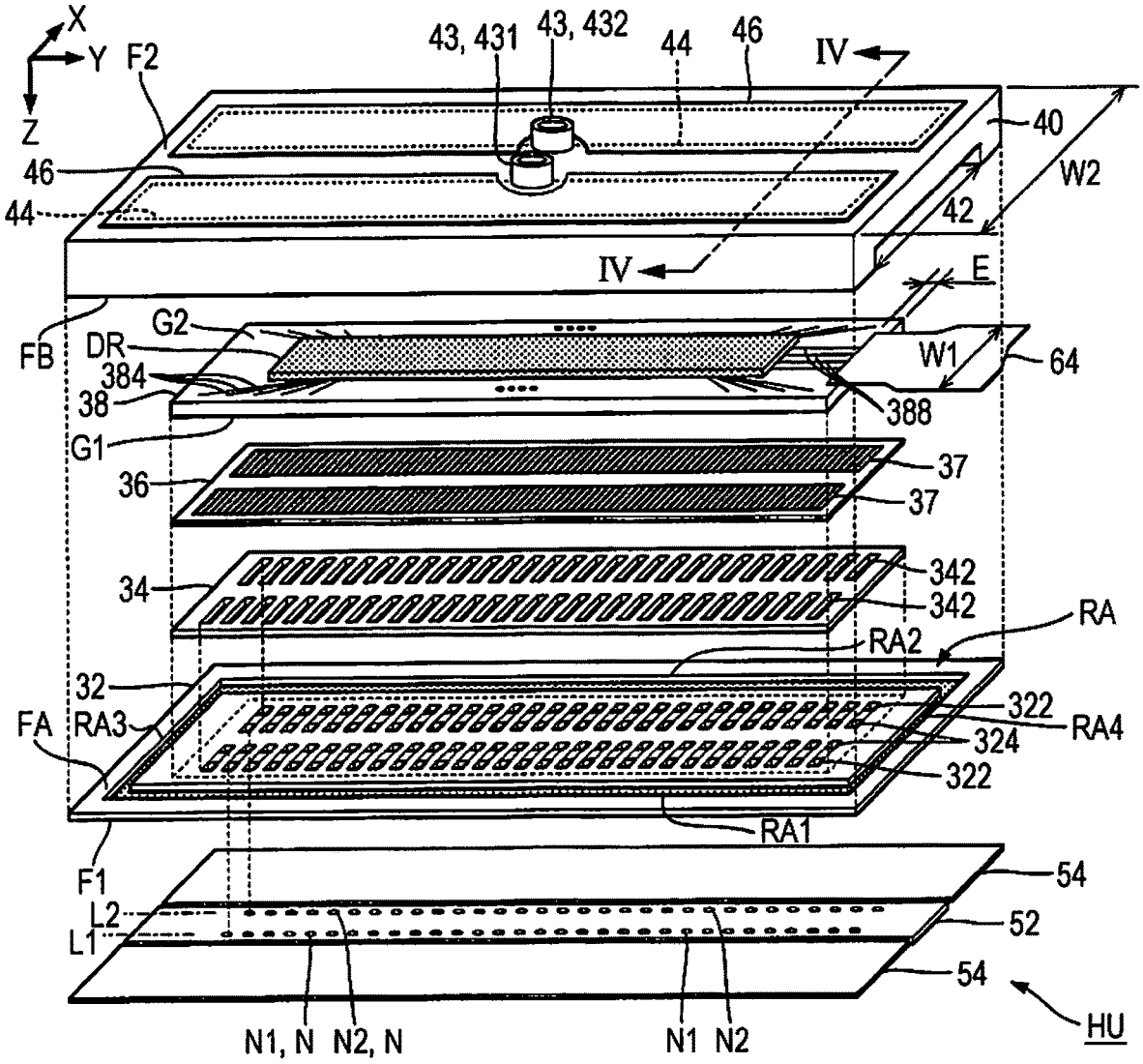
FIG. 3 is an exploded perspective view of a piezoelectric print head.
Figure 4:
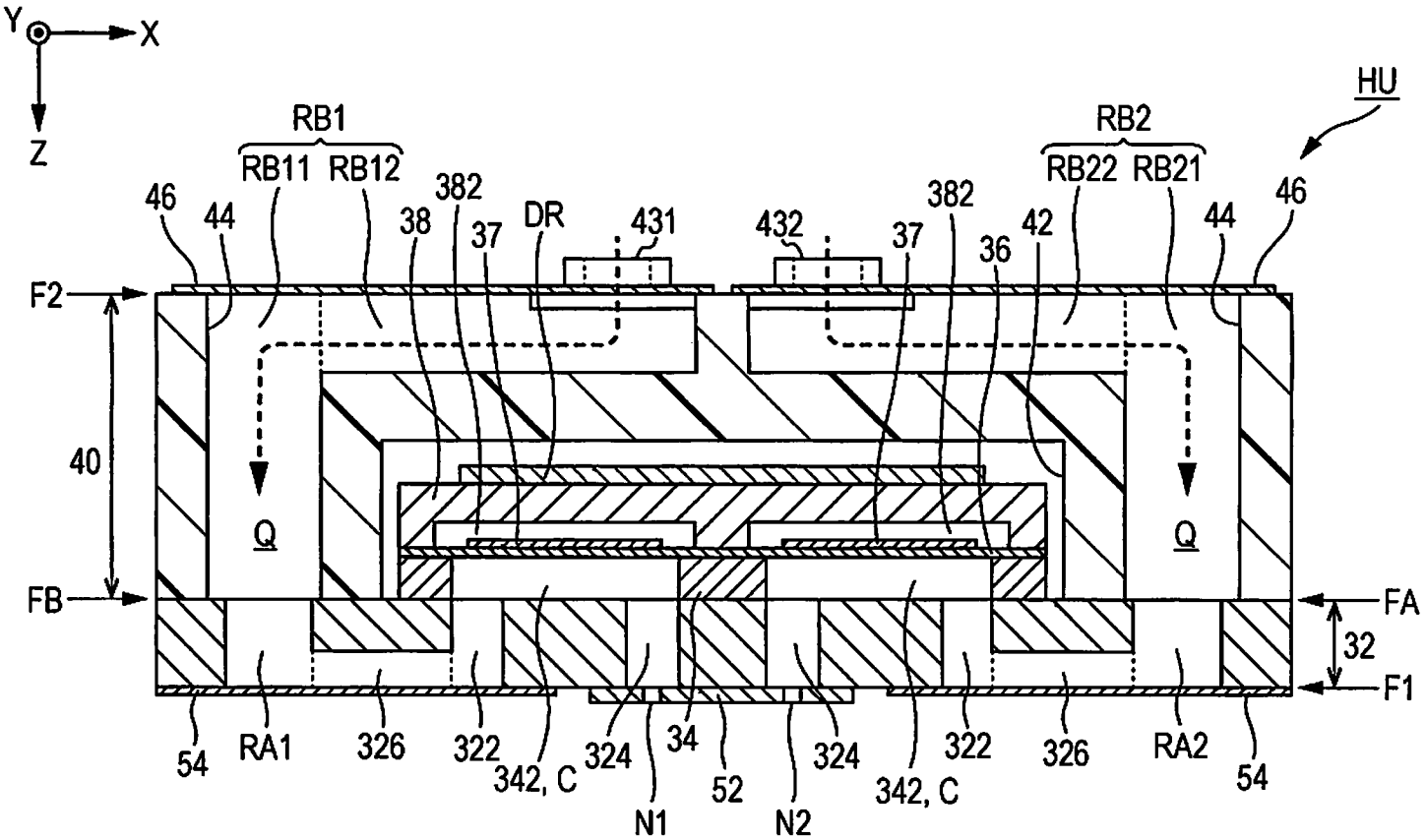
FIG. 4 is a sectional view of the piezoelectric print head.

FIG. 3 is an exploded perspective view of each piezoelectric print head HU. FIG. 4 is a sectional view taken along line IV-IV in FIG. 3.

As shown in FIG. 3, the piezoelectric print head HU includes a number 2M of nozzles N arrayed in the Y-axis direction. In this embodiment, the number 2M of nozzles N are arrayed to be divided into two rows of a row L1 and a row L2. In the following description, each of a number M of nozzles N belonging to the row L1 may be referred to as nozzle N1, and each of a number M of nozzles N belonging to the row L2 may be referred to as nozzle N2. In this embodiment, it is expected that, as an example, the position of a j-th nozzle N1 from the −Y side of the number M of nozzles N1 belonging to the row L1 is substantially the same in the Y-axis direction as the position of a j-th nozzle N2 from the −Y side of the number M of nozzles N2 belonging to the row L2 (j is a natural number satisfying 1≤j≤M). In this case, "substantially the same" is conception involving a situation being completely the same, and a situation being apparently the same within tolerance.

Alternatively, the number 2M of nozzles N may be arrayed in a zigzag manner or a staggered manner such that the position of the j-th nozzle N1 from the −Y side of the number M of nozzles N1 belonging to the row L1 is different in the Y-axis direction from the position of the j-th nozzle N2 from the −Y side of the number M of nozzles N2 belonging to the row L2.

As shown in FIGS. 3 and 4, the piezoelectric print head HU includes a channel substrate 32. The channel substrate 32 is a plate-shaped member having a surface F1 and a surface FA. The surface F1 is a surface on the +Z side (a surface on the medium 12 side when viewed from the piezoelectric print head HU). The surface FA is a surface (on the −Z side) opposite to the surface F1. A pressure-chamber substrate 34, a vibration portion 36, a plurality of piezoelectric elements 37, a protection member 38, and a casing 40 are provided on or above the surface FA. A nozzle plate 52 and a vibration absorber 54 are provided on the surface F1. Respective elements of the piezoelectric print head HU are generally plate-shaped members long in the Y-axis direction like the channel substrate 32. Respective components are joined to one another by using, for example, an adhesive. Note that the direction in which the channel substrate 32, the pressure-chamber substrate 34, the protection member 38, and the nozzle plate 52 are stacked can be recognized as the Z-axis direction.

The nozzle plate 52 is a plate-shaped member having the number 2M of nozzles N formed therein. For example, the nozzle plate 52 is provided on the surface F1 of the channel substrate 32 by using, for example, an adhesive. The nozzles N are through-holes provided in the nozzle plate 52. The nozzle plate 52 is manufactured, for example, by processing a monocrystal substrate of silicon (Si) by using a semiconductor manufacturing technology such as etching. Note that a known material and a known manufacturing method may be desirably employed for manufacturing the nozzle plate 52.

In this embodiment, it is expected that the nozzle plate 52 has the number M of nozzles N corresponding to each of the row L1 and the row L2 with a density of 300 nozzles or more per inch. Note that the nozzle plate 52 may have the number M of nozzles N corresponding to each of the row L1 and the row L2 with a density of 100 nozzles or more per inch, and further preferably with a density of 200 nozzles or more per inch. Alternatively, M may be 400 or more. In this case, 400 or more nozzles N are arrayed in each of the row L1 and the row L2.

The channel substrate 32 is a plate-shaped member that forms a channel of ink. As shown in FIGS. 3 and 4, the channel substrate 32 has a channel RA. The channel RA includes a channel RA1 provided to correspond to the row L1, a channel RA2 provided to corresponds to the row L2, a channel RA3 that couples the channel RA1 to the channel RA2, and a channel RA4 that couples the channel RA1 to the channel RA2. The channel RA1 is an opening formed to extend long in the Y-axis direction. The channel RA2 is an opening located on the +X side when viewed from the channel RA1, and formed to extend long in the Y-axis direction.

The channel substrate 32 has a number 2M of channels 322 and a number 2M of channels 324 (an example of "communication channels") to correspond to the number 2M of nozzles N in a one-to-one correspondence. The channels 322 and the channels 324 are openings formed to extend through the channel substrate 32 as shown in FIG. 4. The channels 324 communicate with the nozzles N corresponding to the channels 324.

Furthermore, two channels 326 are formed in the surface F1 of the channel substrate 32 as shown in FIG. 4. One of the two channels 326 is a channel that couples the channel RA1 to the number M of channels 322 corresponding to the number M of nozzles N1 belonging to the row L1 in a one-to-one correspondence, and the other one of the two channels 326 is a channel that couples the channel RA2 to the number M of channels 322 corresponding to the number M of nozzles N2 belonging to the row L2 in a one-to-one correspondence.

As shown in FIGS. 3 and 4, the pressure-chamber substrate 34 is a plate-shaped member having a number 2M of openings 342 to correspond to the number 2M of nozzles N in a one-to-one correspondence. The pressure-chamber substrate 34 is mounted on the surface FA of the channel substrate 32, for example, by using an adhesive.

The channel substrate 32 and the pressure-chamber substrate 34 are manufactured, for example, by processing a monocrystal substrate of silicon (Si) by using a semiconductor manufacturing technology. Note that a known material and a known manufacturing method may be desirably employed for manufacturing the channel substrate 32 and the pressure-chamber substrate 34.

As shown in FIGS. 3 and 4, the vibration portion 36 is provided on a surface of the pressure-chamber substrate 34 opposite to the channel substrate 32. The vibration portion 36 is a plate-shaped member configured to elastically vibrate. Alternatively, the pressure-chamber substrate 34 and the vibration portion 36 may be integrally formed by selectively removing a portion in the plate-thickness direction of the plate-shaped member that forms the vibration portion 36 in a region corresponding to the openings 342.

As it is understood from FIG. 4, the vibration portion 36 opposes the surface FA of the channel substrate 32 with a space interposed therebetween at the inside of each opening 342. The space between the surface FA of the channel substrate 32 and the vibration portion 36 at the inside of the opening 342 functions as a pressure chamber C that applies a pressure to the ink filled in the space. That is, in this embodiment, the vibration portion 36 is an example of "a vibration plate" that forms a wall surface of the pressure chamber C. The pressure chamber C is, for example, a space having a long-side direction in the X-axis direction and a short-side direction in the Y-axis direction. The piezoelectric print head HU has a number 2M of pressure chambers C to correspond to the number 2M of nozzles N in a one-to-one correspondence. As shown in FIG. 4, the pressure chambers C provided to correspond to the nozzles N1 communicate with the channel RA1 via the channels 322 and the channel 326, and communicate with the nozzles N1 via the channels 324. Also, the pressure chambers C provided to correspond to the nozzles N2 communicate with the channel RA2 via the channels 322 and the channel 326, and communicate with the nozzles N2 via the channels 324.

As shown in FIGS. 3 and 4, a number 2M of piezoelectric elements 37 are provided on a surface of the vibration portion 36 opposite to the pressure chambers C, to correspond to the number 2M of pressure chambers C in a one-to-one correspondence. Each piezoelectric element 37 is a passive element that is deformed in accordance with supply of the driving signal Com.

As described above, each piezoelectric element 37 is deformed (driven) in accordance with the supply of the driving signal Com. The vibration portion 36 vibrates in association with the deformation of the piezoelectric element 37. When the vibration portion 36 vibrates, the pressure in the corresponding pressure chamber C varies. Then, when the pressure in the pressure chamber C varies, the ink filled in the pressure chamber C is ejected through the corresponding channel 324 and the corresponding nozzle N. In this embodiment, it is expected that the driving signal Com can drive the piezoelectric element 37 so that the ink is ejected from the nozzle N 30,000 times or more per second.

Note that the pressure chamber C, the channel 322, the nozzle N, the vibration portion 36, and the piezoelectric element 37 function as an ejection unit D that ejects the ink filled in the pressure chamber C.

The protection member 38 shown in FIGS. 3 and 4 is a plate-shaped member that protects the number 2M of piezoelectric elements 37 formed on the vibration portion 36. The protection member 38 is provided on a surface of the vibration portion 36 or a surface of the pressure-chamber substrate 34. That is, in this embodiment, the protection member 38 is provided above the ejection units. The protection member 38 is manufactured, for example, by processing a monocrystal substrate of silicon (Si) by using a semiconductor manufacturing technology. Note that a known material and a known manufacturing method may be desirably employed for manufacturing the protection member 38.

The protection member 38 has two housing spaces 382 in a surface G1 which is a surface of the protection member 38 on the +Z side. One of the two housing spaces 382 houses the number M of piezoelectric elements 37 corresponding to the number M of nozzles N1. The other one of the two housing spaces 382 houses the number M of piezoelectric elements 37 corresponding to the number M of nozzles N2. The housing space 382 functions as "a sealed space" in which the piezoelectric elements 37 are sealed to protect the piezoelectric elements 37 from being deteriorated due to the influence of, for example, oxygen or moisture when the protection member 38 is arranged above the ejection units. Note that the width in the Z-axis direction (height) of each housing space 382 (or each sealed space) is sufficiently large so that the piezoelectric elements 37 do not contact the protection member 38 even when the piezoelectric elements 37 are displaced. Thus, even when the piezoelectric elements 37 are displaced, the noise caused by the displacement of the piezoelectric elements 37 is prevented from propagating to the outside of the housing space 382 (or the sealed space).

The head driver DR is provided on a surface G2 which is a surface of the protection member 38 on the −Z side. That is, the protection member 38 functions as "a circuit board" for mounting the head driver DR.

The head driver DR switches between supply and non-supply of the driving signal Com to each piezoelectric element 37 under the control of the print signal SI. While the driving signal Com is generated by the control mechanism 20 in this embodiment, the invention is not limited to such an aspect, and the driving signal Com may be generated by the head driver DR.

As shown in FIGS. 3 and 4, the head driver DR according to this embodiment overlaps at least partial piezoelectric elements 37 of the number 2M of piezoelectric elements 37 provided on the piezoelectric print head HU in a plan view. Also, the head driver DR according to this embodiment overlaps both piezoelectric elements 37 corresponding to the nozzles N1 and piezoelectric elements 37 corresponding to the nozzles N2 in a plan view.

As shown in FIG. 3, a number 2M of wiring 384 are formed on the surface G2 of the protection member 38, for example, to correspond to the number 2M of piezoelectric elements 37 in a one-to-one correspondence. The wiring 384 each are electrically coupled to the head driver DR. Also, the wiring 384 each are electrically coupled to a connection terminal provided on the surface G1 via a continuity hole (contact hole) extending through the protection member 38. The connection terminal is electrically coupled to an electrode of the corresponding piezoelectric element 37. Thus, the driving signal Com output from the head driver DR is supplied to the piezoelectric element 37 via the wiring 384, the continuity hole, and the connection terminal.

In addition, as shown in FIG. 3, a plurality of wiring 388 are formed on the surface G2 of the protection member 38, and are electrically coupled to the head driver DR. The plurality of wiring 388 extend to a region E which is an end portion on the +Y side of the surface G2 of the protection member 38. A wiring member 64 is joined to the region E of the surface G2. The wiring member 64 is a component having a plurality of wiring that electrically couple the control mechanism 20 to the head driver DR. For example, the wiring member 64 may be a flexible wiring substrate, such as a flexible printed circuit (FPC) or a flexible flat cable (FFC).

As shown in FIGS. 3 and 4, the casing 40 is a case that stores ink to be supplied to the number 2M of pressure chambers C (and further the number 2M of nozzles N). A surface FB which is a surface on the +Z side of the casing 40 is fixed to the surface FA of the channel substrate 32, for example, by using an adhesive. As shown in FIGS. 3 and 4, the surface FB of the casing 40 has a recess 42 having a groove shape extending in the Y-axis direction. The protection member 38 and the head driver DR are housed in the recess 42. The wiring member 64 joined to the region E of the protection member 38 extends in the Y-axis direction to pass through the inside of the recess 42. As it is understood from FIG. 3, a width W1 (the maximum value of the dimension in the X-axis direction) of the wiring member 64 is smaller than a width W2 of the casing 40 (W1<W2).

In this embodiment, the casing 40 is formed of a material different from the materials of the channel substrate 32 and the pressure-chamber substrate 34. The casing 40 is formed, for example, by injection molding a resin material. Note that a known material and a known manufacturing method may be desirably employed for manufacturing the casing 40. The material of the casing 40 may be, for example, synthetic fiber such as poly p-phenylenebenzobisoxazole (Zylon (registered trademark)); or a resin material such as a liquid crystal polymer.

As shown in FIG. 4, the casing 40 has a channel RB. The channel RB includes a channel RB1 that communicates with the channel RA1, and a channel RB2 that communicates with the channel RA2. The channel RA and the channel RB function as reservoirs Q that store ink to be supplied to the number 2M of pressure chambers C.

Two inlets 43 through which ink supplied from the liquid container 14 is introduced to the reservoirs Q are provided in a surface F2 which is a surface on the −Z side of the casing 40. One of the two inlets 43 (hereinafter, occasionally referred to as inlet 431) communicates with the channel RB1, and the other one of the two inlets 43 (hereinafter, occasionally referred to as inlet 432) communicates with the channel RB2.

As shown in FIG. 4, the channel RB1 is a space long in the Y-axis direction, and includes a channel RB11 that communicates with the channel RA1, and a channel RB12 that communicates with the inlet 43. The channel RB2 is a space long in the Y-axis direction, and includes a channel RB21 that communicates with the channel RA2, and a channel RB22 that communicates with the inlet 43.

As it is understood from FIG. 4, the protection member 38 and the head driver DR are located between the channel RB11 and the channel RB21. That is, the protection member 38 and the head driver DR are provided in a space between the channel RB11 and the channel RB21. In other words, in a sectional view in the X-axis direction (from the +X side or the −X side), the region where the protection member 38 and the head driver DR are provided is included in the region where the channel RB11 or the channel RB21 is provided.

Also, as it is understood from FIG. 4, in a plan view from the +Z side or the −Z side, at least a portion of the protection member 38 and at least a portion of the head driver DR are located between the channel RB12 or the channel RB22 and the pressure chambers C. That is, at least a portion of the protection member 38 and at least a portion of the head driver DR are provided between the reservoir Q and the pressure chambers C.

Also, as it is understood from FIG. 4, at least a portion of the protection member 38 and at least a portion of the head driver DR are located between the piezoelectric elements 37 and the channel RB12 or the channel RB22. At least a portion of the protection member 38 and at least a portion of the head driver DR are provided between the reservoir Q and the piezoelectric elements 37. In other words, in a plan view, at least a portion of the reservoir Q overlaps at least a portion of the protection member 38, at least a portion of the head driver DR, and at least a portion of the piezoelectric elements 37.

As shown by a broken-line arrow in FIG. 4, the ink supplied from the liquid container 14 to the inlet 431 flows into the channel RA1 via the channel RB12 and the channel RB11. Part of the ink flowing into the channel RA1 is supplied to the pressure chambers C corresponding to the nozzles N1 via the channel 326 and the channels 322. For example, the ink filled in the pressure chambers C corresponding to the nozzles N1 flows through the channels 324 to the +Z side, and is ejected from the nozzles N1.

The ink supplied from the liquid container 14 to the inlet 432 flows into the channel RA2 via the channel RB22 and the channel RB21. Part of the ink flowing into the channel RA2 is supplied to the pressure chambers C corresponding to the nozzles N2 via the channel 326 and the channels 322. For example, the ink filled in the pressure chambers C corresponding to the nozzles N2 flows through the channels 324 to the +Z side, and is ejected from the nozzles N2.

As shown in FIGS. 3 and 4, the two inlets 43 and openings 44 corresponding to the above-described reservoirs Q are formed in the surface F2 of the casing 40. Also, two vibration absorbers 46 are provided on the surface F2 of the casing 40 to close the openings 44. The vibration absorbers 46 each are a flexible film (a compliance substrate) that absorbs a variation in pressure of ink in the corresponding reservoir Q, and forms a wall surface of the reservoir Q.

Also, as shown in FIG. 3, vibration absorbers 54 are provided on the surface F1 of the channel substrate 32 to close the two channels 326 of the channel RA1 and the channel RA2, and the plurality of channels 322. The vibration absorbers 54 each are a flexible film (a compliance substrate) that absorbs a variation in pressure of ink in the reservoir Q, and forms a wall surface of the reservoir Q.

In general, a driving signal Com for driving a piezoelectric element 37 is a large-amplitude signal. Hence, the head driver DR generates heat when supplying the driving signal Com to the piezoelectric element 37. In particular, when the number of times of driving of the piezoelectric element 37 per unit time is large like this embodiment, the amount of heat generated by the head driver DR increases. Also, when the ejection units including the nozzles N and the piezoelectric elements 37 are provided in the piezoelectric print head HU with a high density like this embodiment, the amount of heat per unit area generated by the head driver DR increases. When the head driver DR is downsized to downsize the piezoelectric print head HU, the amount of heat per unit area generated by the head driver DR increases. Further, when the protection member 38 provided with the head driver DR is provided above the ejection unit, the head driver DR and the protection member 38 do not contact the air outside the piezoelectric print head HU. Alternatively, the contact area of the head driver DR and the protection member 38 with respect to the air outside the piezoelectric print head HU decreases. Owing to this, heat release efficiency from the head driver DR decreases, and the head driver DR may be at high temperatures.

In contrast, in this embodiment, the head driver DR and the protection member 38 are provided between the channel RB11 and the channel RB21. Accordingly, in this embodiment, even when the head driver DR and the protection member 38 do not directly contact the air outside the piezoelectric print head HU, the heat generated from the head driver DR can be released via the ink in the reservoirs Q.

Also, in this embodiment, a circulation path is formed in order of "the channel RA1→the channel RA3→the channel RA2→the channel RA4→the channel RA1." Accordingly, in this embodiment, as compared with a configuration in which the reservoirs Q do not have the ink circulation path, the heat generated from the head driver DR can be efficiently released via the ink in the reservoirs Q.

Also, in this embodiment, the head driver DR and the protection member 38 are provided between the reservoirs Q and the pressure chambers C. Accordingly, in this embodiment, the heat generated from the head driver DR can be efficiently released via the ink in the reservoirs Q and the ink in the pressure chambers C.

Also, in this embodiment, the reservoirs Q include the channel RB12 and the channel RB22 that are portions overlapping at least a portion of the protection member 38 and at least a portion of the head driver DR in a plan view. Accordingly, in this embodiment, as compared with a configuration in which the reservoirs Q do not overlap the protection member 38 and the head driver DR in a plan view, the piezoelectric print head HU can be easily downsized and the volume of the reservoirs Q can be easily increased.

Also, in this embodiment, the piezoelectric elements 37 are housed in the housing spaces 382 formed in the surface G1 of the protection member 38, and the head driver DR is provided on the surface G2 of the protection member 38. In other words, in this embodiment, the piezoelectric elements 37 are housed in the back surface of the substrate on which the head driver DR is formed. Accordingly, in this embodiment, as compared with a configuration in which the piezoelectric elements 37 are provided at a location different from the back surface of the substrate on which the head driver DR is formed, the path length of wiring for electrically coupling the head driver DR to the piezoelectric elements 37 can be decreased. Accordingly, in this embodiment, the waveform of the driving signal Com can be prevented from being disordered due to the resistance component and capacity component of the wiring; and the wiring resistance is decreased and the amount of heat generated by the wiring can be decreased.

Also, in this embodiment, since the wiring member 64 is arranged in the region E at the end portion of the protection member 38, as compared with a case where the wiring member 64 extends in a region from an end portion to a position around the center of the protection member 38, the space for arranging the wiring member 64 can be decreased. Accordingly, in this embodiment, the piezoelectric print head HU can be easily downsized, and the volume of the reservoirs Q can be easily increased.

Also, in this embodiment, since the vibration absorbers 54 and 46 absorb a variation in pressure in the reservoirs Q, the possibility that the variation in pressure in the reservoirs Q propagates to the pressure chambers C and changes the ejection characteristics of ink (for example, the ejection amount, ejection speed, ejection direction) can be decreased.

1-4. Configuration and Operation of Head Driver

The configuration and operation of the head driver DR are described next with reference to FIGS. 5 to 11.

Figure 5:
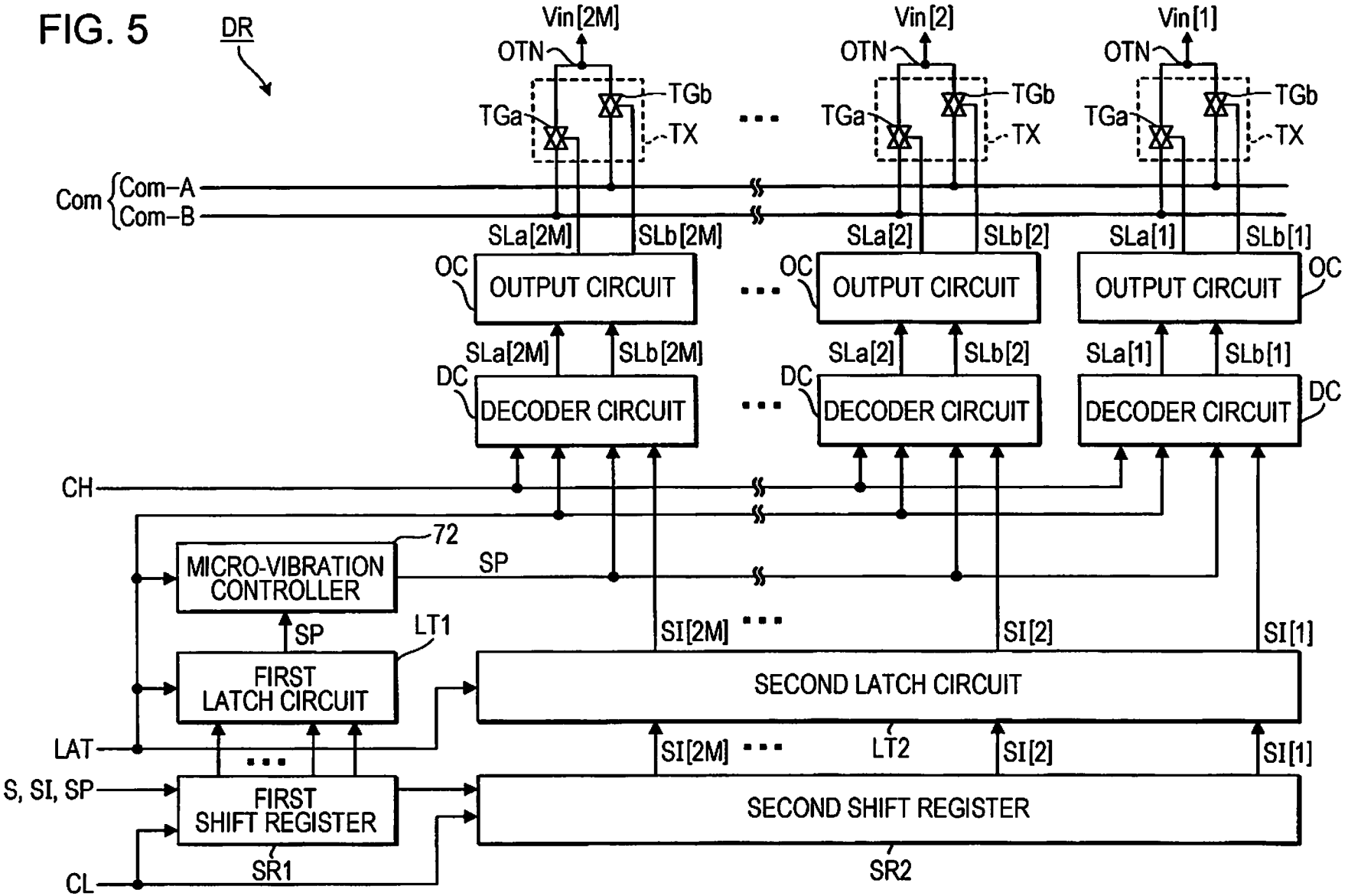
FIG. 5 is a block diagram showing an electric configuration of a head driver.

FIG. 5 is a block diagram showing the configuration of the head driver DR. As shown in FIG. 5, the head driver DR includes a first shift register SR1, a second shift register SR2, a first latch circuit LT1, a second latch circuit LT2, and a micro-vibration controller 72. Also, the head driver DR has a number 2M of groups each including a decoder circuit DC, an output circuit OC, and a switch unit TX, to correspond to a number 2M of ejection units D[1] to D[2M] in a one-to-one correspondence.

A clock signal CL, a control signal S, a latch signal LAT, a change signal CH, and a driving signal Com are supplied from the control mechanism 20 to the head driver DR.

As described above, the driving signal Com that is supplied to the head driver DR includes driving signals Com-A and Com-B. The driving signals Com-A and Com-B are signals having waveforms for driving the ejection units D.

Figure 6A:
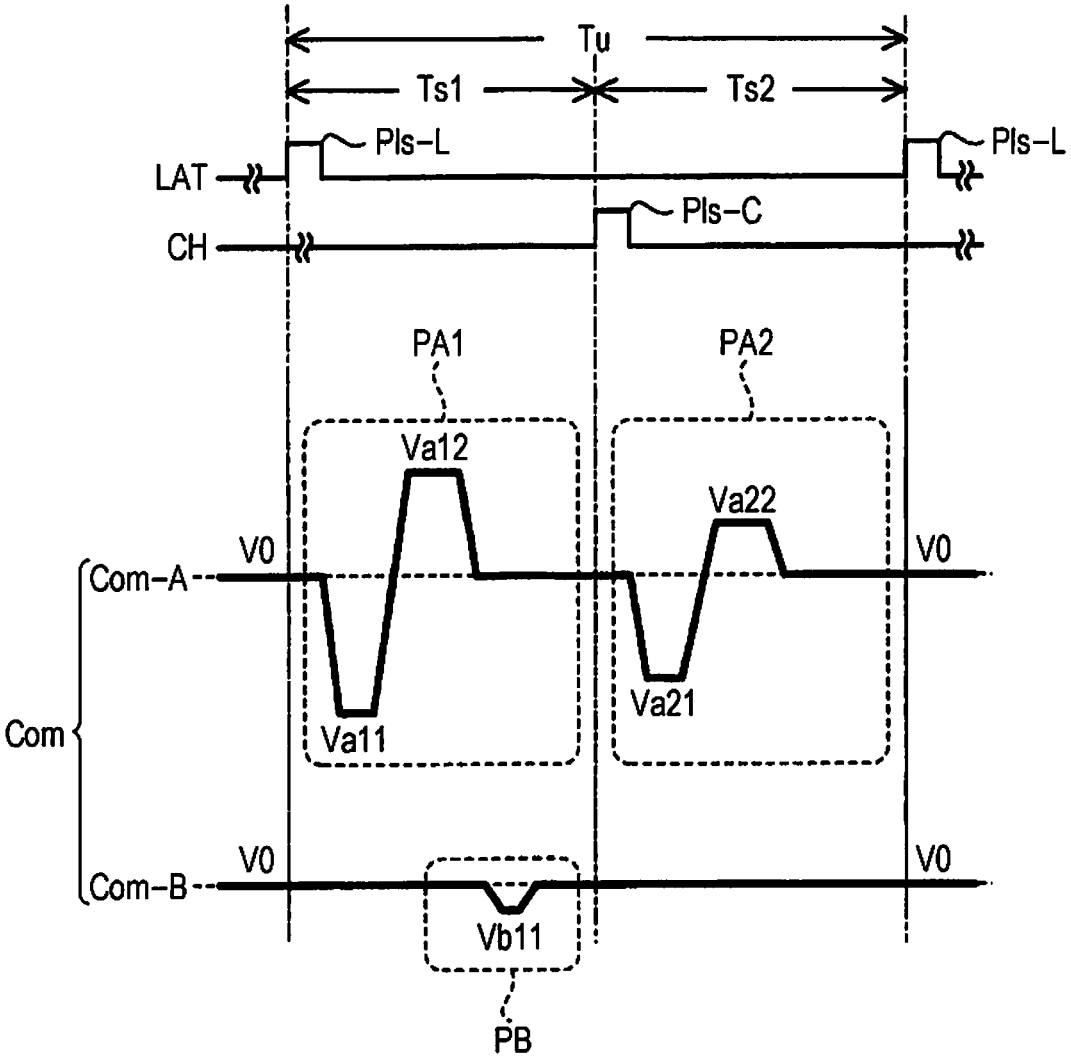
FIG. 6A is a waveform diagram of driving signals.

An operation period in which the piezoelectric ink jet printer 1 executes print processing includes a plurality of unit periods Tu. FIG. 6A is a timing chart of various signals that are supplied from the control mechanism 20 to the head driver DR in each unit period Tu. In this embodiment, the control mechanism 20 divides the unit period Tu into a control period Ts1 and a control period Ts2 by the change signal CH. In this embodiment, it is assumed that the control periods Ts1 and Ts2 have equivalent lengths of time. In the following description, the control periods Ts1 and Ts2 are occasionally collectively referred to as control period Ts.

As shown in FIG. 6A, the unit period Tu is determined (divided) by a pulse Pls-L included in the latch signal LAT. The control periods Ts1 and Ts2 are determined (divided) by the pulse Pls-L and a pulse Pls-C included in the change signal CH. The driving signal Com-A of each unit period Tu has an ejection waveform PA1 provided in the control period Ts1, and an ejection waveform PA2 provided in the control period Ts2.

The ejection waveform PA1 is a waveform that causes an ejection unit D[m] to eject a medium amount of ink corresponding to a medium dot when an individual driving signal Vin[m] having the ejection waveform PA1 is supplied to the ejection unit D[m]. When medium-dot ink is ejected, as shown in FIG. 6B, the individual driving signal Vin[m] having the ejection waveform PA1 in the control period Ts1 is supplied to the piezoelectric element 37.

The ejection waveform PA2 is a waveform that causes the ejection unit D[m] to eject a small amount of ink corresponding to a small dot when an individual driving signal Vin[m] having the ejection waveform PA2 is supplied to the ejection unit D[m].

For example, the potential difference between the lowest potential (in this example, potential Va11) and the highest potential (in this example, potential Va12) of the ejection waveform PA1 is larger than the potential difference between the lowest potential (in this example, potential Va21) and the highest potential (in this example, potential Va22) of the ejection waveform PA2.

Figure 6B:
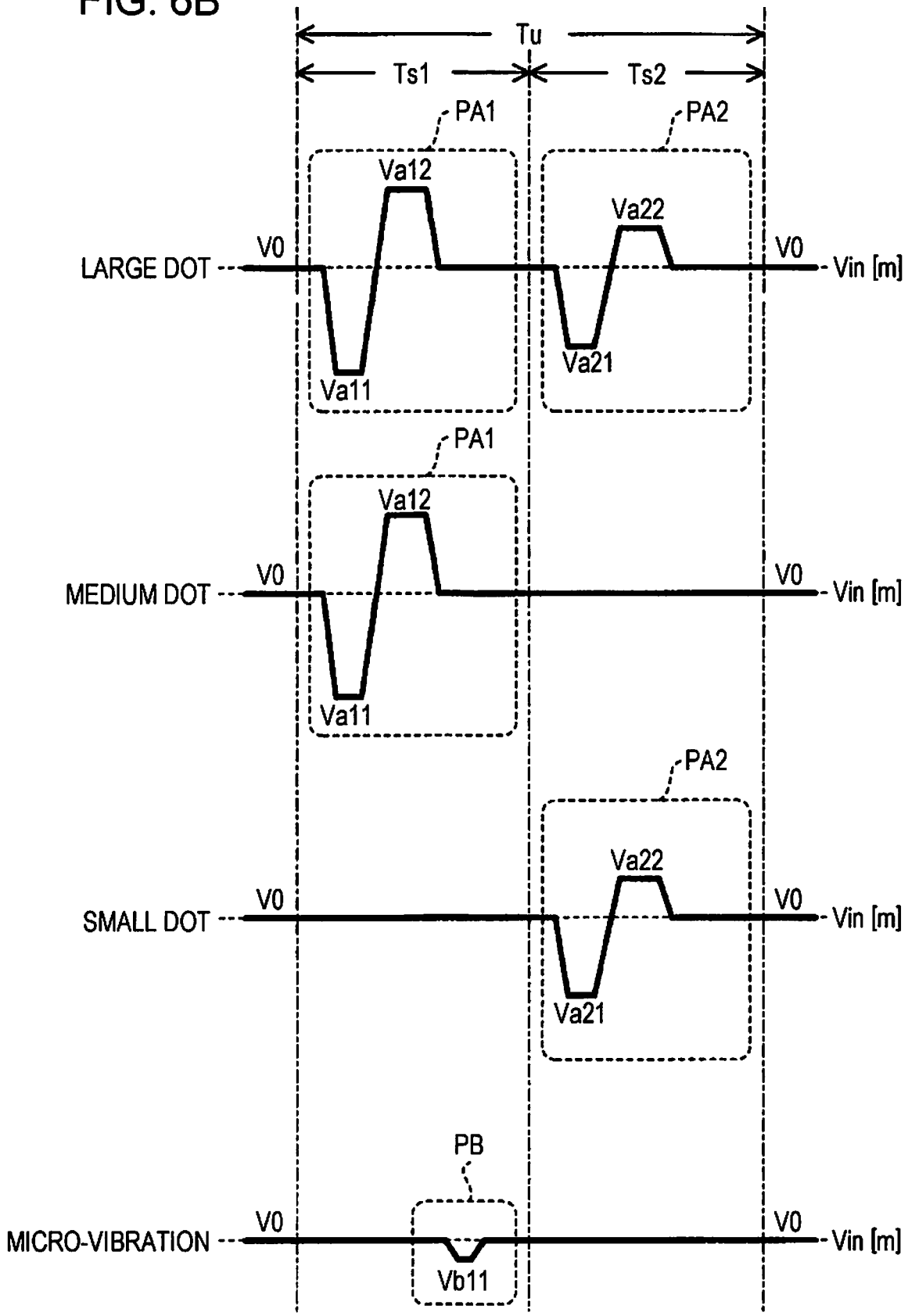
FIG. 6B is a waveform diagram of individual driving signals.

When small-dot ink is ejected, as shown in FIG. 6B, the individual driving signal Vin[m] having the ejection waveform PA2 in the control period Ts2 is supplied to the piezoelectric element 37.

When large-dot ink is ejected, as shown in FIG. 6B, the individual driving signal Vin[m] having the ejection waveform PA1 in the control period Ts1 and the ejection waveform PA2 in the control period Ts2 is supplied to the piezoelectric element 37.

As shown in FIG. 6A, the driving signal Com-B in each unit period Tu has a micro-vibration waveform PB. The micro-vibration waveform PB is a waveform that causes the ejection unit D[m] not to eject ink when an individual driving signal Vin[m] having the micro-vibration waveform PB is supplied to the ejection unit D[m]. That is, the micro-vibration waveform PB is a waveform for applying micro-vibration to ink in the ejection unit D and preventing an increase in viscosity of the ink. For example, the potential difference between the lowest potential (in this example, potential Vb11) and the highest potential (in this example, reference potential V0) of the micro-vibration waveform PB is smaller than the potential difference between the lowest potential and the highest potential of the ejection waveform PA2.

The print signals SI are digital 2-bit signals that determine the amounts of ink to be ejected from the ejection units D[1] to D[2M] and micro-vibration as described above. The amounts of ink and micro-vibration are designated with 2 bits of an upper bit b1 and a lower bit b2. When the print signal SI[m] is (b1, b2)=(1, 1), ejection of large-dot ink is designated. When the print signal SI[m] is (b1, b2)=(1, 0), ejection of medium-dot ink is designated. When the print signal SI[m] is (b1, b2)=(0, 1), ejection of small-dot ink is designated. When the print signal SI[m] is (b1, b2) (0, 0), micro-vibration is designated (see FIG. 7).

The waveform select signal SP is a signal with 16 bits of a bit b1 to a bit b16. In the waveform select signal SP, the bits b1 to b4 indicate information for designating a waveform when large-dot ink is ejected, the bits b5 to b8 indicate information for designating a waveform when medium-dot ink is ejected, and the bits b9 to b12 indicate information for designating a waveform when small-dot ink is ejected. Further, in the waveform select signal SP, the bits b13 and b14 indicate information for designating non-ejection of ink and a micro-vibration waveform (see FIG. 7).

The bits b1, b5, b9, and b13 of the waveform select signal SP indicate "1" when the driving signal Com-A is selected in the control period Ts1, and "0" when the driving signal Com-A is not selected. The bits b2, b6, b10, and b14 of the waveform select signal SP indicate "1" when the driving signal Com-B is selected in the control period Ts1, and "0" when the driving signal Com-B is not selected. The bits b3, b7, b11, and b15 of the waveform select signal SP indicate "1" when the driving signal Com-A is selected in the control period Ts2, and "0" when the driving signal Com-A is not selected. The bits b4, b8, b12, and b16 of the waveform select signal SP indicate "1" when the driving signal Com-B is selected in the control period Ts2, and "0" when the driving signal Com-B is not selected. For example, when the waveform select signal SP is (b1, b2, b3, b4)=(1, 0, 0, 1), it is designated that the driving signal Com-A is selected in the control period Ts1 and the driving signal Com-B is selected in the control period Ts2.

Figure 8:
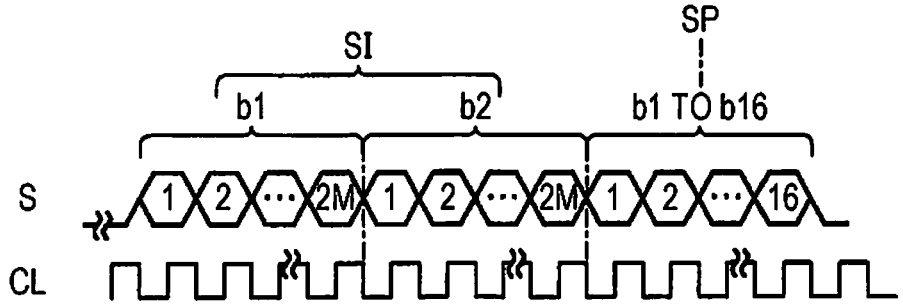
FIG. 8 is an explanatory view showing control signals.

FIG. 8 shows control signals S supplied from the control mechanism 20. The control signals S includes upper bits b1 of a number 2M of print signals SI, lower bits b2 of a number 2M of print signals SI, and 16 bits b1 to b16 of waveform select signals SP, which are sequentially arranged in that order.

Figure 9:
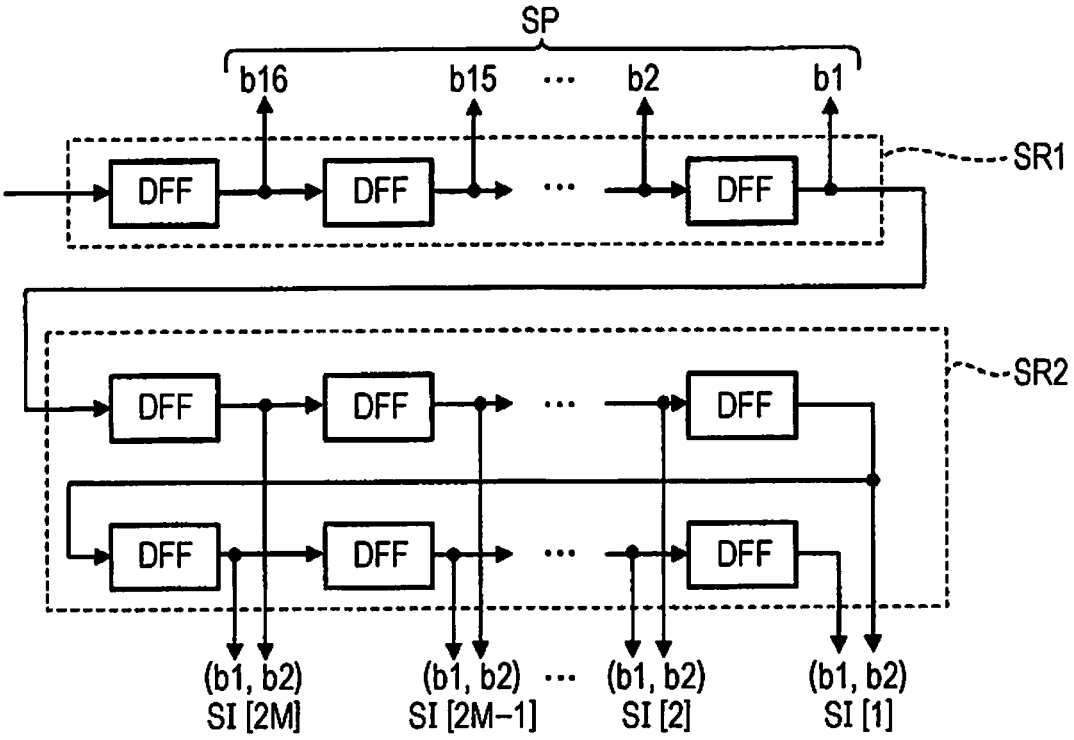
FIG. 9 is a circuit diagram showing specific configurations of a first shift register and a second shift register.

FIG. 9 shows a specific configuration of the first shift register SR1 and the second shift register SR2. In the first shift register SR1, 16 D flip-flops DFF are connected in series. In the second shift register SR2, a number 4M of D flip-flops DFF are connected in series. A number 4M+16 of clock signals CL are supplied to each D flip-flop DFF every unit period Tu. As the result that the control signals S are sequentially transferred in accordance with the number 4M+16 of clock signals CL, as shown in FIG. 9, 16-bit waveform select signals SP are held in the first shift register SR1, and a number 2M of print signals SI[1] to SI[m] are held in the second shift register SR2.

The first latch circuit LT1 shown in FIG. 5 latches the waveform select signal SP output from the first shift register SR1, at a timing at which the latch signal LAT rises. Also, the second latch circuit LT2 latches the number 2M of print signals SI[1] to SI[2M] output from the second shift register SR2, at a timing at which the latch signal LAT rises. The control mechanism 20, to the head driver DR, supplies the control signals S every unit period Tu, and the latch signal LAT so that the first latch circuit LT1 latches the waveform select signals SP and the second latch circuit LT2 latches the print signals SI.

An m-th-stage print signal SI[m] output from the second latch circuit LT2 is supplied to an m-th-stage decoder circuit DC. In contrast, the waveform select signal SP latched by the first latch circuit LT1 is supplied to the micro-vibration controller 72. If a predetermined condition is satisfied, the micro-vibration controller 72 changes the micro-vibration information of the waveform select signal SP included in the control signal S and output the micro-vibration information to the decoder circuits DC of the 1st-stage to the 2M-th stage. The micro-vibration controller 72 provided commonly to the decoder circuits DC of the 1st-stage to the 2M-th stage. If a predetermined condition is satisfied, the micro-vibration controller 72 functions as a change unit that changes the control signal S supplied from the outside and outputs the control signal S.

As shown in FIG. 5, the head driver DR includes a number 2M of switch units TX to correspond to the number 2M of ejection units D[1] to D[2M] in a one-to-one correspondence. Each switch unit TX includes a transmission gate TGa and a transmission gate TGb. A transmission gate TGa[m] provided for an m-th-stage switch unit TX[m] is tuned ON when a select signal SLa[m] is at H level, and is turned OFF when the select signal SLa[m] is at L level. Also, a transmission gate TGb[m] provided for the m-th-stage switch unit TX[m] is tuned ON when a select signal SLb[m] is at H level, and is turned OFF when the select signal SLb[m] is at L level. The transmission gate TGa and the transmission gate TGb function as switches that switch between supply and non-supply of the driving signal Com to the piezoelectric element 37.

The m-th-stage decoder circuit DC outputs a select signal SL[m] based on the print signal SI[m], the waveform select signal SP, and the change signal CH. In this embodiment, the select signal SL[m] includes a select signal SLa[m] for selecting the driving signal Com-A and a select signal SLb[m] for selecting the driving signal Com-B. The levels of the select signal SLa[m] and the select signal SLb[m] output from the decoder circuit DC are shifted and the current of these are amplified by the output circuit OC, and the result is output to the switch unit TX[m]. The decoder circuit DC functions as a switch controller that controls ON/OFF of the transmission gates TGa and TGb (switches) based on the control signal S.

FIG. 7 shows decoding contents of the m-th-stage decoder circuit DC. As shown in FIG. 7, the decoder circuit DC generates a select signal SLa[m] and a select signal SLb[m] corresponding to a large dot, a medium dot, a small dot, and micro-vibration based on (b1, b2) of the print signal SI[m].

For example, when (b1, b2) of the print signal SI[m] is (0, 1), small-dot ejection is designated. In this case, the select signal SLa[m] in the control period Ts1 is set to L level, the select signal SLb[m] in the control period Ts1 is set to L level, the select signal SLa[m] in the control period Ts2 is set to H level, and the select signal SLb[m] in the control period Ts2 is set to L level, in accordance with (0, 0, 1, 0) which are values of (b9, b10, b11, b12) of the waveform select signal SP.

Figure 10:
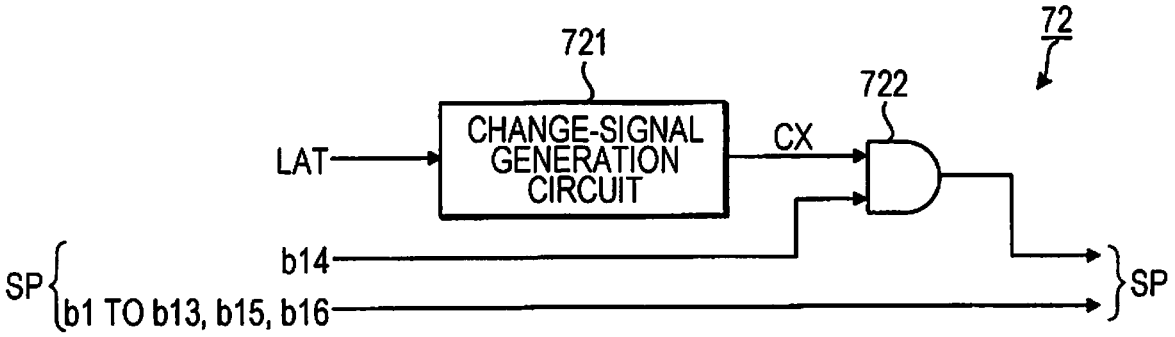
FIG. 10 is a block diagram showing an electric configuration of a micro-vibration controller.
Figure 11:
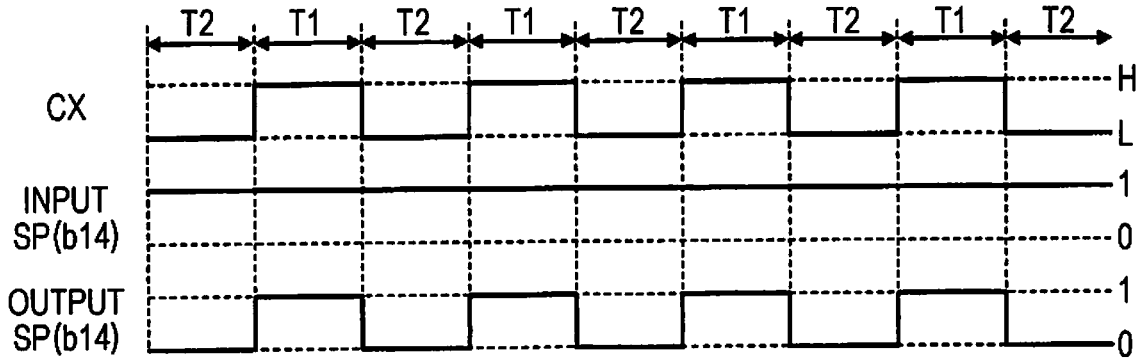
FIG. 11 is a timing chart showing an operation of the micro-vibration controller.

The micro-vibration controller 72 is described next. FIG. 10 is a block diagram of the micro-vibration controller 72. FIG. 11 is a timing chart of the micro-vibration controller 72. As shown in FIG. 10, the micro-vibration controller 72 includes a change-signal generation circuit 721 and an AND circuit 722. The change-signal generation circuit 721 generates a change signal CX that is active if a predetermined condition is satisfied and is inactive if the predetermined condition is not satisfied. In this example, the change signal CX is active at L level, and is inactive at H level.

The change-signal generation circuit 721 counts rising edges of the latch signal LAT. The change signal CX is set to H level until a number K1 of latch signals LAT are counted, then the change signal CX is set to L level until a number K2 of latch signals LAT are counted, and the process is repeated. Note that K1 and K2 are desirable natural numbers. Since the values of K1 and K2 are properly set, the duty ratio of the change signal CX can be changed. In this example, K1=K2 is established. Thus, the duty ratio of the change signal CX is 50% as shown in FIG. 11.

The change signal CX is supplied to one of input terminals of the AND circuit 722, and a bit b14 of the waveform signal SP is supplied to the other input terminal. The bits b13 to b16 of the waveform select signal SP function as micro-vibration information as described above, and as shown in FIG. 7, (b13, b14, b15, b16)=(0, 1, 0, 0) is established. The bit b14 represents that the micro-vibration waveform PB is selected in the control period Ts1 shown in FIG. 6A. When (b13, b14, b15, b16)=(0, 1, 0, 0) as the waveform select signal SP is supplied to the decoder circuit DC, the decoder circuit DC detects the bit b14, and sets the select signal SLb[m] to H level in the control period Ts1.

The AND circuit 722 replaces the value of the bit b14 with the value of the logical AND of the change signal CX and the bit b14 of the input waveform select signal SP. When the change signal CX is inactive and at H level, the waveform select signal SP is output while the bit b14 of the input waveform select signal SP is held at "1." In contrast, when the change signal CX is active, the bit b14 of the input waveform select signal SP is held replaced with "0," and the waveform select signal SP is output. Consequently, the micro-vibration information after the replacement is changed to (b13, b14, b15, b16)=(0, 0, 0, 0). When the waveform select signal SP including the micro-vibration information after the replacement is supplied to the decoder circuit DC, the decoder circuit DC detects the bit b14, and sets the select signal SLb[m] to L level in the control period Ts1. Consequently, the transmission gate TGb[m] is turned OFF in the control period Ts1, and hence even when the print signal SI[m] designates micro-vibration, the micro-vibration waveform PB is not supplied to the piezoelectric element 37.

That is, while b14 of the waveform select signal SP that is input to the micro-vibration controller 72 is constantly "1," b14 of the waveform select signal SP that is output from the micro-vibration controller 72 is switched between "1" and "0" in synchronization with the change signal CX.

In the first period T1 in which the change signal CX shown in FIG. 11 is inactive, the micro-vibration waveform PB is supplied to the piezoelectric element 37 if the print signal SI[m] is (b1, b2)=(0, 0), and the micro-vibration waveform PB is not supplied to the piezoelectric element 37 if the print signal SI[m] is the other value. That is, the first period T1 is a period in which the micro-vibration waveform PB is allowed to be supplied to the piezoelectric element 37.

In contrast, in the second period T2 in which the change signal CX is active, the micro-vibration waveform PB is not supplied to the piezoelectric element 37 even if the print signal SI[m] is (b1, b2)=(0, 0). That is, the second period T2 is a period in which the micro-vibration waveform PB is not allowed to be supplied to the piezoelectric element 37. In this embodiment, a processing period in which the first period T1 and the second period T2 define one cycle is repeated to eject ink from a nozzle N. A predetermined condition of this embodiment is the second period T2. Accordingly, in the second period T2, the micro-vibration waveform PB is not supplied to the piezoelectric element 37 even when the print signal SI[m] designates micro-vibration. Thus, micro-vibration designated with the print signal SI[m] can be skipped. When micro-vibration is skipped, the logic level of the select signal SLb[m] is set to L level to turn OFF the transmission gate TGb.

Generation of heat by the head driver DR is considerable when micro-vibration is generated. In this case, heat is not released because ink is not ejected. The transmission gate TGb is changed from OFF to ON to select the micro-vibration waveform PB, the micro-vibration waveform is selected, and then the transmission gate TGb is changed from ON to OFF.

Large current flows to the output circuit OC when the logic level of the select signal SLb[m] is changed from L level to H level, and when the logic level of the select signal SLb[m] is changed from H level to L level. Thus, when micro-vibration is designated, the output circuit OC generates heat like the case where ink is ejected.

In contrast, when micro-vibration is skipped, the transmission gate TGb is turned OFF, and the electric power consumed by the output circuit OC is decreased as compared with the case of micro-vibration. Also, since the driving signal Com-B is not supplied to the piezoelectric element 37 via the transmission gate TGb, the electric power consumed by the transmission gate TGb is decreased. Thus, by reducing occurrence of micro-vibration, generation of heat by the output circuit OC and the transmission gate TGb can be suppressed, and generation of heat by the head driver DR can be suppressed. Consequently, the influence of heat received by ink can be suppressed, the risk of deterioration of ink can be decreased, and further ejection stability can be increased.

Also, the micro-vibration controller 72 according to this embodiment has a configuration common to the number 2M of nozzles N. As compared with a case where the micro-vibration controller 72 is provided for each of the number 2M of nozzles N in a one-to-one correspondence, the configuration can be simplified. Further, micro-vibration can be skipped only by changing a portion of the existing control signal S. Thus, the configuration can be simplified.

Also, by adjusting the length of the first period T1 and the length of the second period T2, the effect of decreasing the viscosity of liquid by micro-vibration and the effect of decreasing the temperature rise of liquid can be well-balanced.

2. Modifications

The embodiment exemplarily described above may be modified in various ways. Specific modification aspects are exemplarily described below. Two or more aspects desirably selected from the examples may be properly combined unless the examples are inconsistent with each other.

First Modification

While the change-signal generation circuit 721 is provided in the head driver DR in the above-described embodiment, the invention is not limited thereto, and the change signal CX may be supplied from the outside of the head driver DR.

Second Modification

While the waveform select signal SP is exemplified for the micro-vibration information for supplying the micro-vibration waveform PB to the piezoelectric element 37, the invention is not limited thereto, and the print signal SI may be used. In this case, it is presupposed that the print signal SI can designate non-vibration as an operation state of the ejection unit D, in addition to micro-vibration with which ink is not ejected. In this state, ink is not ejected and the driving signal Com is not supplied to the piezoelectric element 37. When the print signal SI indicates micro-vibration in the second period T2 in which the change signal CX is active, the micro-vibration controller 72 may replace the print signal SI indicting micro-vibration with the print signal SI indicating non-vibration, and may supply the print signal SI to the decoder circuit DC.

Third Modification

While the change signal CX is generated based on the count result of the latch signals LAT in the above-described embodiment, the invention is not limited thereto, and any measure may be taken as long as micro-vibration can be skipped.

For example, a temperature detection unit that detects a temperature, and a change unit that changes a control signal supplied from the outside and outputs the control signal if the temperature detected by the temperature detection unit is a predetermined temperature or higher may be included. More specifically, the change-signal generation circuit 721 may detect a temperature, and a change signal CX may be set active if the detected temperature is a predetermined temperature or higher, and may be set inactive if the detected temperature is lower than the predetermined temperature.

Fourth Modification

The piezoelectric ink jet printer 1 exemplified in each of the above-described embodiment and modifications may be applied to, in addition to an apparatus dedicated to printing, various apparatuses, such as a facsimile apparatus and a copy machine. The purpose of use of the piezoelectric ink jet printer according to the invention is not limited to printing. For example, a piezoelectric ink jet printer that ejects liquid of a color material is used as a manufacturing apparatus that forms a color filter for a liquid crystal display device. Also, a piezoelectric ink jet printer that ejects a solution of an electrically conductive material is used for a manufacturing apparatus that forms wiring and electrodes for a wiring substrate.

What is claimed is:

1. A piezoelectric print head, comprising:

a piezoelectric element;

a nozzle that ejects liquid when the piezoelectric element is driven;

a switch that switches between supply and non-supply of a driving signal for driving the piezoelectric element to the piezoelectric element;

a change unit that changes a control signal supplied from outside and outputs the control signal if a predetermined condition is satisfied; and a switch controller that controls ON/OFF of the switch based on the control signal output from the change unit.

2. The piezoelectric print head according to claim 1, wherein the driving signal includes a micro-vibration waveform that causes the liquid not to be ejected when the micro-vibration waveform is supplied to the piezoelectric element, wherein the control signal includes micro-vibration information for supplying the micro-vibration waveform to the piezoelectric element, wherein the change unit changes a content of the micro-vibration information if the predetermined condition is satisfied, and wherein, when the switch is controlled based on the control signal having the changed micro-vibration information, the micro-vibration waveform of the driving signal is not supplied to the piezoelectric element.

3. A piezoelectric ink jet printer, comprising:

the piezoelectric print head according to claim 2, wherein the liquid is ink.

4. The piezoelectric print head according to claim 1, wherein the liquid has properties that are deteriorated at a temperature lower than 100° C.

5. A piezoelectric ink jet printer, comprising:

the piezoelectric print head according to claim 4, wherein the liquid is ink.

6. The piezoelectric print head according to claim 1, wherein 400 or more nozzles including the nozzle are arranged in a row with a density of 300 or more nozzles per inch, and wherein the piezoelectric element, the switch, and the switch controller are provided for each of the 400 or more nozzles.

7. A piezoelectric ink jet printer, comprising:

the piezoelectric print head according to claim 6, wherein the liquid is ink.

8. The piezoelectric print head according to claim 1, wherein a processing period including as one cycle a first period in which the micro-vibration waveform is allowed to be supplied to the piezoelectric element and a second period in which the micro-vibration waveform is not allowed to be supplied to the piezoelectric element is repeated and hence the nozzle ejects the liquid, and wherein the predetermined condition is the second period.

9. A piezoelectric ink jet printer, comprising:

the piezoelectric print head according to claim 8, wherein the liquid is ink.

10. The piezoelectric print head according to claim 1, comprising:

a plurality of nozzles including the nozzle;

the piezoelectric element, the switch, and the switch controller provided for each of the plurality of nozzles; and the change unit commonly provided for the plurality of nozzles.

11. A piezoelectric ink jet printer, comprising:

the piezoelectric print head according to claim 10, wherein the liquid is ink.

12. The piezoelectric print head according to claim 1, further comprising:

a circuit board provided with the switch, the change unit, and the switch controller; and a pressure chamber filled with liquid and having an internal pressure that increases and decreases in accordance with driving of the piezoelectric element, wherein the piezoelectric element is provided in a sealed space that is defined by a plurality of members including the circuit board.

13. A piezoelectric ink jet printer, comprising:

the piezoelectric print head according to claim 12, wherein the liquid is ink.

14. A piezoelectric ink jet printer, comprising:

the piezoelectric print head according to claim 1, wherein the liquid is ink.

15. The piezoelectric print head according to claim 1, wherein the switch controller is disposed between the switch and the change unit.

* * * * *